US010682000B2

(12) United States Patent
Eriksen

(10) Patent No.: US 10,682,000 B2
(45) Date of Patent: Jun. 16, 2020

(54) DYSPHAGIA CUP

(71) Applicant: FLAVOUR CREATIONS PTY LTD, Acacia Ridge, Queensland (AU)

(72) Inventor: Bernadette Mary Eriksen, Tennyson (AU)

(73) Assignee: FLAVOUR CREATIONS PTY LTD, Acacia Ridge, Queensland ( * ) Notice: Subject to any disclaimer, the term of this patent is extended or adjusted under 35 U.S.C. 154(b) by 53 days.

(21) Appl. No.: 15/764,371

(22) PCT Filed: Sep. 30, 2016

(86) PCT No.: PCT/AU2016/050931
§ 371 (c)(1),
(2) Date: Mar. 29, 2018

(87) PCT Pub. No.: WO2017/054060
PCT Pub. Date: Apr. 6, 2017

(65) Prior Publication Data

US 2018/0279814 A1 Oct. 4, 2018

(30) Foreign Application Priority Data

Sep. 30, 2015 (AU) ..... 2015234327

(51) Int. Cl.
*A47G 19/22* (2006.01)
*B65D 1/26* (2006.01)

(52) U.S. Cl.
CPC ..... *A47G 19/2266* (2013.01); *B65D 1/26* (2013.01); *A47G 2200/048* (2013.01)

(58) Field of Classification Search
CPC ..... A47G 19/2266; A47G 2200/048; B65D 1/26; B65D 1/40
See application file for complete search history.

(56) References Cited

U.S. PATENT DOCUMENTS 2,627,735 A 2/1953 Dexter et al.
6,047,845 A * 4/2000 Rapaz ..... A47G 19/02 220/501
7,080,752 B2 7/2006 Bergeron
2005/0121456 A1 6/2005 Cutler et al.
(Continued)

OTHER PUBLICATIONS

Merriam Webster, Definition of cup, Nov. 21, 2019, Merriam Webster, p. 2 of 13.*

*Primary Examiner* — Stephen J Castellano
(74) *Attorney, Agent, or Firm* — TraskBritt

(57) ABSTRACT

A cup for a patient suffering from dysphagia comprises a base upon which the cup is capable of standing when on a level surface and a leading wall extending from the base. The leading wall has a first portion that is substantially planar or concave when viewed from outside the cup, the first portion being at an angle of at least 100 degrees relative to the base. The cup also comprises a trailing wall opposite the leading wall, wherein the trailing wall extends from the base to the lip of the cup; and side walls extending between the leading and trailing walls, the side walls being convex when viewed from outside of the cup. The lip of the cup is upwardly inclined relative to the base in the direction of the trailing wall to the leading wall. The cup allows a patient suffering from dysphagia to drink without having to unduly tip back his or her head.

18 Claims, 12 Drawing Sheets

(56) References Cited

U.S. PATENT DOCUMENTS

| | | | | |
|---|---|---|---|---|
| 2009/0142454 | A1* | 6/2009 | Clark | B65D 1/34<br>426/115 |
| 2009/0188927 | A1 | 7/2009 | Allen | |

* cited by examiner

DYSPHAGIA CUP

This application is the national stage (Rule 371) of international application No. PCT/AU2016/050931 filed Sep. 30, 2016.

TECHNICAL FIELD

The present invention relates to cups, and especially to cups for patients suffering from dysphagia. The present invention also relates to cup assemblies including the cups, and to methods of using the cups.

BACKGROUND ART

It will be clearly understood that, if a prior art publication is referred to herein, this reference does not constitute an admission that the publication forms part of the common general knowledge in the art in Australia or in any other country.

Dysphagia includes any swallowing dysfunction, including an inability to swallow or a disorder in the swallowing process. Dysphagia increases in prevalence amongst the elderly, and it has been estimated that 40-50% of elderly patients in long-term care facilities suffer from dysphagia. Dysphagia can occur from a variety of causes, including any condition that weakens or damages the muscles or nerves used for swallowing. Causes of dysphagia may include, but not limited to, cancer (including cancer of the head, neck, or esophagus), stroke, Alzheimer's disease, dementia, multiple sclerosis, muscular dystrophy, Parkinson's disease, head or neck injuries, birth defects, cerebral palsy, MND, MS, and advanced age.

People with dysphagia can find it difficult to manipulate food and beverages in their mouth and to subsequently swallow, and so malnutrition, dehydration and possibly renal failure can occur. UTI's (Urinary tract infections) are high in this population group. Furthermore, as people with dysphagia may have difficulty controlling food or beverages to be ingested (for example in the mouth), when the swallow is initiated the airways are not protected causing substances to enter their lungs. If such substances enter the lungs aspiration pneumonia can occur, which is frequently fatal. Some dysphagic individuals have little mobility so the usual bodily movements cannot assist in clearing the lungs. Even if complications such as aspiration pneumonia do not eventuate, it can be extremely tiring for many people with dysphagia to cough up substances which are trapped around the epiglottis or inadvertently enter the lungs (especially if those people are frail or elderly). Often the act or strain of coughing can bring on heart failure for those with already weakened hearts.

People suffering from dysphagia frequently cannot safely drink from a normal beverage cup by themselves. This can represent a loss of independence, which can have a severe psychological impact on dysphagia sufferers. Consequently, it is important that cups to be used by people with dysphagia are designed so that those people can use the cups themselves (where possible) and maintain their independence.

Various cups are currently available for patients suffering from dysphagia. By way of example, some cups rely on a patient sucking fluid from a straw which may be integral with a cup lid. A problem with this approach is that sucking requires coordination of various muscles and can be difficult for some patients. This can also present a further danger as the sucking is not controlled and sudden large amounts of liquid can quickly enter the mouth causing the person to gag or choke.

Other cups are designed so that a patient with dysphagia tilts the cup whilst drinking. However, frequently such cups require the patient to lift their chin whilst drinking. Lifting the chin extends the neck and tends to open the airway to the lungs, which can result in fluid or food entering the lungs. Furthermore, when drinking from such cups it can be difficult for patients to control the flow rate of liquid exiting the cup, as the flow rate is typically determined by the gradual elevation of the patient's chin and the shape of the cup.

SUMMARY OF INVENTION

The present invention is directed to, inter alia, a cup for a patient suffering from dysphagia which may at least partially overcome at least one of the abovementioned disadvantages or provide the consumer with a useful or commercial choice.

With the foregoing in view, in a first aspect the present invention relates to a cup for a patient suffering from dysphagia, wherein the cup comprises:

- a base upon which the cup is capable of standing when on a level surface; and
- a leading wall extending from the base, wherein at least 50% of the length of the leading wall is at an angle of at least 100 degrees relative to the base, and wherein in a plane parallel to the base a lip of the leading wall is arcuate with a greater curvature than a lower region of the leading wall.

As used herein, the term "dysphagia" includes any swallowing disorder, including an inability to swallow, difficulty in swallowing or discomfort in swallowing. As discussed above, dysphagia can occur as a result of various causes.

As used herein, the "leading wall" of the cup is the wall of the cup that faces a patient, if the patient were drinking from the cup. The cup may be configured so that the patient's lip contacts the leading wall of the cup if the patient were drinking from the cup.

The cup defined in the first aspect has numerous advantages. First, at least 50% of the length of the leading wall is at an angle of at least 100 degrees relative to the base. This feature may enable a patient suffering from dysphagia to drink from the cup whilst minimizing chin lift. Minimization of chin lift may permit: decreased neck extension (which opens the airway and can result in choking if a beverage (for example) enters the lungs); and increased ease of use by patients, as less chin lift may allow for greater control of the rate at which fluid exits the cup when drinking and consequently more time within which a patient can react to fluid exiting the cup when drinking. Secondly, a greater curvature at the lip of the leading wall may allow for greater control by a patient of the flow rate of fluid exiting the cup. Thirdly, a lesser curvature in a lower region of the leading wall may allow a patient to better grip the cup due to: (i) decreased distance between the leading wall and the trailing wall (the trailing wall may be opposite the leading wall); and (ii) potentially providing a region within which the thumb may be comfortably located when holding the cup. Improved ability to grip the cup can be very important as patients with dysphagia frequently also suffer from other conditions which may affect fine motor movements of the hands (such as arthritis). Fourthly, the cup is capable of standing on its base when on a level surface. This may enable a patient to safely put down the cup without drinking its contents. Any or all of the above may allow a patient suffering from dysphagia to independently drink from the cup long after it has ceased to be possible to drink from other more standard cups.

In one embodiment, at least 55% of the length of the leading wall is at an angle of at least 100 degrees relative to the base, especially at least 60%, 65%, 70%, 75%, 80%, 85% or 90% of the of the length of the leading wall is at an angle of at least 100 degrees relative to the base. The angle of at least 100 degrees relative to the base may be an angle of at least 101, 102, 103 or 104 degrees relative to the base. In one embodiment, the at least 55% of the length of the leading wall is the lower at least 55% of the length of the leading wall.

The leading wall may include a first portion proximate to the base of the cup. The first portion may extend for at least 30% of the length of the leading wall, especially at least 35%, 40%, 45%, 50%, 55% or 60% of the length of the leading wall. The first portion may extend for from 30% to 80% of the length of the leading wall, especially from 40% to 70% of the length of the leading wall, more especially from 50% to 70% or from 55% to 65% of the length of the leading wall, most especially about 60% of the length of the leading wall. The first portion may be at an angle of at least 100 degrees relative to the base of the cup, especially at an angle of at least 101, 102, 103 or 104 degrees relative to the base. The first portion may be at an angle of from 100 to 115 degrees relative to the base, especially at an angle of from 100 to 110 degrees relative to the base, more especially at an angle of from 101 to 109 degrees, or 102 to 108 degrees, or 103 to 107 degrees, or 104 to 106 degrees relative to the base. In one embodiment, the first portion is at an angle of about 105 degrees relative to the base of the cup.

The leading wall may include a second portion distal to the base of the cup adjacent the first portion. The second portion may curve outwardly from the center of the cup (especially in a longitudinal direction). The second portion may extend for less than 50% of the length of the leading wall, especially less than 40% or less than 30% of the length of the leading wall. The second portion may extend for from 10% to 40% of the length of the leading wall, especially from 15% to 35% or from 20% to 30% of the length of the leading wall, most especially about 25% of the length of the leading wall.

The leading wall may also include a third portion distal the base of the cup and adjacent to the second portion. The third portion may extend for less than 20% of the length of the wall, more especially less than 15% of the length of the wall. The third portion may extend for from 5% to 20% of the length of the wall, especially from 10% to 15% of the length of the wall. At least a section of the third portion may be at angle of from 80 to 100 degrees relative to the base, especially from 85 to 95 degrees relative to the base, or substantially perpendicular relative to the base. The third portion may include the lip of the leading wall.

As used herein, where a percentage of the length of the leading wall is provided, this is the length as measured longitudinally from the base to the lip. In one embodiment, the leading wall may be from 8 to 10 cm long, especially about 9 cm long. The first portion may be about 5.5 cm long. The second portion may be about 2.2 cm long. The third portion may be about 1.3 cm long.

In the first aspect, a lip of the leading wall is arcuate with a greater curvature than a lower region of the leading wall in a plane parallel to the base. In one embodiment, the lip of the leading wall may have a smaller radius of curvature than the lower region of the leading wall. Both the lip of the leading wall and the lower region of the leading wall may be arcuate. The lower region may be concave when viewed from outside the cup. The lower region may be substantially planar. The lower region may be adapted to provide a depression to accommodate a patient's thumb.

The lower region of the leading wall may be the first portion of the leading wall or the first portion of the leading wall may include the lower region. The lip of the leading wall may be the third portion of the leading wall, or the third portion of the leading wall may include the lip of the leading wall.

The width of the leading wall may taper as the wall extends from the base to the lip. The width of the first portion may be substantially constant along its length. The first portion may have a ratio of width to length of 1:from 1-2, especially of 1: from 1.25 to 1.75, most especially of about 1:1.5. In one embodiment, the first portion may be about 3.5 to 4 cm wide, especially about 3.7 cm wide. The width of the second portion may narrow towards the lip. The second portion may be generally arch-shaped when viewed from the outside and/or inside of the cup. The third portion, together with the other walls of the cup, may define a circle, oval or ellipse.

The leading wall (or the first portion of the leading wall) may include at least one, and especially a plurality of longitudinally extending ridges. The leading wall (or the first portion of the leading wall) may include at least 3, 4, 5, 6 or 7 longitudinally extending ridges, especially from 5 to 13 or from 6 to 12 or from 7 to 11 or from 8 to 10 longitudinally extending ridges. The leading wall (or the first portion of the leading wall) may include 9 longitudinally extending ridges. Each ridge may be from 1-3 mm thick, especially from 1.5 to 2.5 mm thick, more especially about 2 mm thick. Each ridge may be from 3 to 5 mm apart, especially from 3.5 to 4.5 mm apart, more especially about 4 mm apart. Advantageously, the longitudinally extending ridges may assist a patient to grip the cup, and may also assist in destacking the cups (if a first cup is nested within a second cup).

The leading wall (or the first portion of the leading wall) may include at least one horizontally extending ridge. The leading wall (or the first portion of the leading wall) may include one or two, especially one, horizontally extending ridge. Each ridge may be from 1-3 mm thick, especially from 1.5 to 2.5 mm thick, more especially about 2 mm thick. The horizontally extending ridge may protrude further from the leading wall than the longitudinally extending ridges. Advantageously, the horizontally extending ridge may assist in improving the lateral rigidity of the leading wall (especially the first portion of the leading wall) and may stabilize the cup in the holder (discussed below).

The base may be connected to or in register with the first portion of the leading wall. The junction of the base and the first portion of the leading wall may be rounded or beveled.

The cup may include a trailing wall opposite to the leading wall. The trailing wall may extend from the base. The trailing wall may be adapted to accommodate a patient's fingers when drinking from the cup. The cup may not include a plane of symmetry between the leading and trailing walls. The cup may include a plane of symmetry bisecting the leading and trailing walls.

At least 10%, 20%, 30%, 40%, 50%, 60%, 70% or 80% of the length of the trailing wall may be at an angle of less than 105 degrees relative to the base, especially less than 104, 103, 102, 101, 100 or 99 degrees relative to the base. The angle of less than 105 degrees relative to the base may be an angle of from 90 to 105 degrees, especially from 93 to 103 degrees, or from 95 to 101 degrees, or from 97 to 100 degrees or from 98 to 99 degrees relative to the base. A portion of the trailing wall may be substantially planar or concave when viewed from outside the cup.

The trailing wall may include a first portion proximate to the base of the cup. The first portion may extend for at least 30% of the length of the trailing wall, especially at least 35%, 40%, 45%, 50%, 55%, 60%, 65%, 70% or 75% of the length of the trailing wall. The first portion of the trailing wall may extend for from 50% to 95% of the length of the trailing wall, especially from 60% to 90% of the length of the trailing wall, more especially from 65% to 85% or from 70% to 80% of the length of the trailing wall. The first portion of the trailing wall may be at an angle of less than 105 degrees relative to the base, especially less than 104, 103, 102, 101, 100 or 99 degrees relative to the base. The first portion of the trailing wall at an angle of less than 105 degrees relative to the base may be an angle of from 90 to 105 degrees, especially from 93 to 103 degrees, or from 95 to 101 degrees, or from 97 to 100 degrees or from 98 to 99 degrees relative to the base.

The trailing wall may include a second portion distal to the base of the cup adjacent the first portion. The second portion of the trailing wall may curve outwardly from the center of the cup (especially in a longitudinal direction). The second portion may extend for less than 40% of the length of the trailing wall, especially less than 30% or less than 20% of the length of the trailing wall. The second portion of the trailing wall may extend for from 3% to 30% of the length of the trailing wall, especially from 5% to 20% or from 5% to 15% of the length of the trailing wall, most especially from 5% to 10% of the length of the trailing wall.

The trailing wall may also include a third portion distal the base of the cup and adjacent to the second portion. The third portion may extend for less than 30% of the length of the trailing wall, more especially less than 25% of the length of the wall. The third portion may extend for from 5% to 25% of the length of the wall, especially from 10% to 20% of the length of the wall or from 15% to 20% of the length of the wall. At least a section of the third portion may be at angle of from 80 to 100 degrees relative to the base, especially from 85 to 95 degrees relative to the base, or substantially perpendicular relative to the base. The third portion may include the lip of the trailing wall.

As used herein, where a percentage of the length of the trailing wall is provided, this is the length as measured longitudinally from the base to the lip. The leading wall may be from 7 to 9 cm long, especially about 8 cm long. The first portion may be about 6.1 cm long. The second portion may be about 0.6 cm long. The third portion may be about 1.3 cm long.

Advantageously, the distance between the leading and trailing walls (especially at the top of the first portion of the leading and trailing walls) may be less than 80 mm, especially less than 75 mm or less than 71 mm, 70, 65 or 60 mm at the point at which the patient's thumb (on the leading wall) and fingers (on the trailing wall) are intended to contact the cup when drinking A distance of less than 75 mm, especially less than 71 mm advantageously may assist a patient in gripping the cup. It has been found that it can be difficult for some patients to grip vessels if the grip span exceeds 71 mm.

The distance between the leading and trailing walls may be less than 80 mm, especially less than 75 mm or less than 71 mm, 70, 65 or 60 mm at a distance of from 40% to 75% of the height of the cup perpendicularly from the base, especially at a distance of from 50% to 65% of the height of the cup perpendicularly from the base, most especially at a distance of from 55% to 65% or about 60% of the height of the cup perpendicularly from the base. The distance between the leading and trailing walls may be less than 70 mm at a distance of 55% to 65% of the height of the cup perpendicularly from the base. In one embodiment, the distance between the leading and trailing walls may be less than 70 mm at a distance of 5.2-5.5 cm perpendicularly from the base of the cup.

In one embodiment in a plane parallel to the base, a lip of the trailing wall is arcuate with a greater curvature than a lower region of the trailing wall. The lip of the trailing wall may have a smaller radius of curvature than the lower region of the trailing wall. Both the lip of the trailing wall and the lower region of the trailing wall may be arcuate. The lower region of the trailing wall may be concave when viewed from outside the cup. The lower region of the trailing wall may be substantially planar.

The lower region of the trailing wall may be the first portion of the trailing wall or the first portion of the trailing wall may include the lower region. The lip of the trailing wall may be the third portion of the trailing wall, or the third portion of the trailing wall may include the lip of the trailing wall.

The width of the trailing wall may taper as the wall extends from the base to the lip. The width of the first portion of the trailing wall may be substantially constant along its length. The first portion of the trailing wall may have a ratio of width to length of 1:from 1.5-3.5, especially of 1:from 2.0 to 3.0, most especially of about 1:2.5. The first portion of the trailing wall may be about 2 to 3 cm wide, especially about 2.3 cm wide. The width of the second portion of the trailing wall may narrow towards the lip. The second portion of the trailing wall may be generally arch-shaped when viewed from the outside and/or inside of the cup. The third portion of the trailing wall, together with the other walls of the cup, may define a circle, oval or ellipse.

The trailing wall (or the first portion of the trailing wall) may include at least one, and especially a plurality of longitudinally extending ridges. The trailing wall (or the first portion of the trailing wall) may include at least 2, 3, 4 or 5 longitudinally extending ridges, especially from 2 to 8 or from 3 to 7 or from 4 to 6 longitudinally extending ridges. The trailing wall (or the first portion of the trailing wall) may include 5 longitudinally extending ridges. Each ridge may be from 1-3 mm thick, especially from 1.5 to 2.5 mm thick, more especially about 2 mm thick. Each ridge may be from 3 to 5 mm apart, especially from 3.5 to 4.5 mm apart, more especially about 4 mm apart. Advantageously, the longitudinally extending ridges may assist a patient to grip the cup, and may also assist in destacking the cups (if a first cup is nested within a second cup). In one embodiment, the cup is shaped so that a first said cup substantially fits within a second said cup.

The trailing wall (or the first portion of the trailing wall) may include at least one horizontally extending ridge. The trailing wall (or the first portion of the trailing wall) may include one or two, especially one, horizontally extending ridge. Each ridge may be from 1-3 mm thick, especially from 1.5 to 2.5 mm thick, more especially about 2 mm thick. The horizontally extending ridge may protrude further from the trailing wall than the longitudinally extending ridges. Advantageously, the horizontally extending ridge may assist in improving the lateral rigidity of the trailing wall (especially the first portion of the trailing wall) and may stabilize the cup in the holder (discussed below).

The base may be connected to or in register with the first portion of the trailing wall. The junction of the base and the first portion of the trailing wall may be rounded or beveled.

The cup may also include at least one side wall, especially at least two side walls, more especially two side walls. Each said side wall may extend between the leading and trailing walls. Each said at least one side wall may be arcuate in a plane parallel to the base (or a plane defined by the base). At least 10%, 20%, 30%, 40%, 50%, 60%, 70% or 80% of the length of each said side wall may be at an angle of less than 100 degrees relative to the base, especially less than 99, 98, or 97 degrees relative to the base. The angle of less than 100 degrees relative to the base may be an angle of from 90 to 100 degrees, especially from 93 to 99 degrees, or from 94 to 98 degrees, or from 95 to 97 degrees relative to the base. The side walls may extend rearwardly from the leading wall. The side walls may be convex when viewed from outside the cup.

Each said side wall may include at least one, and especially a plurality of longitudinally extending ridges. Each said side wall may include at least 2, 3, 4 or 5 longitudinally extending ridges, especially from 2 to 8 or from 3 to 7 or from 4 to 6 longitudinally extending ridges. Each said side wall may include 5 or 6 longitudinally extending ridges. Each ridge may be from 1-3 mm thick, especially from 1.5 to 2.5 mm thick, more especially about 2 mm thick. Each ridge may be from 4 to 6 mm apart, especially from 4.5 to 5.5 mm apart, more especially about 5 mm apart. The side wall longitudinally extending ridges may be positioned at an angle relative to the base.

The base may be connected to or in register with each said side wall. The junction of the base and each said side wall may be rounded or beveled.

As noted above, the walls of the cup (i.e. the leading, trailing and side walls of the cup), or portions of the walls of the cup may be oriented at different angles relative to the base. The arrangement described above may advantageously allow a patient to more easily drink from the cup (compared to standard more symmetrical cups), whilst minimizing volume losses due to angled walls.

The lip of the cup may be circular, ovoid, or elliptical. The lip may include a flange. The flange may provide a surface for adhesion of a seal (for example if the cup is to be sold including a food or beverage). The flange may be adapted for adhesion of a seal to seal the contents of the cup. The flange may be from 1 mm to 10 mm wide, especially from 3 to 7 mm wide, or from 4 to 6 mm wide, more especially about 5 mm wide. However, the lip also may not include a flange (especially for non-disposable cups). The walls of the cup may define a headspace proximate to the lip. The walls of the cup may define a substantially cylindrical headspace proximate to the lip. However, if the cup is non-disposable the walls of the cup may not define a headspace. The walls defining the headspace may include the third portion of the leading and trailing walls. The lip of the cup may be ovoid or elliptical for accommodating a patient's nose when drinking from the cup.

It may be advantageous for the cup to be ovoid or elliptical, as elongating the lip of the cup along a plane bisecting the leading and trailing walls provides additional room to accommodate the patient's nose when drinking from the cup. Again, this may advantageously assist in ameliorating chin lifting when drinking a beverage from the cup. Furthermore, an ovoid or elliptical shape may assist in slowing the flow rate of liquid exiting the cup.

The lip of the cup may define an oval or ellipse in which the distance between the inside of the leading and trailing walls (i.e. along a plane bisecting the leading and trailing walls) may be from 7 to 8.5 cm, especially about 7.7 cm (the distance between the outside of the leading and trailing walls may be about 8.6 cm). The distance between the inside of the two side walls (i.e. along a plane bisecting the two side walls) may be from 6.0 to 7.5 cm, especially about 6.7 cm (the distance between the outside of the two side walls may be about 7.8 cm). The inner circumference of the lip may be from 200 to 260 mm, especially from 220 to 240 mm, more especially about 230 mm. The outer circumference of the lip may be from 230 to 290 mm, especially from 250 to 270 mm, more especially about 260 mm.

The lip may be angled from a plane defined by the base. The lip may be angled at up to 10 degrees relative to the base, especially up to 7 degrees or 6 degrees or 5 degrees relative to the base. The lip may be angled at from 1-7 degrees relative to the base, especially at from 2-6 degrees or 3-5 degrees or about 4 degrees relative to the base. The lip may be inclined upwardly in the direction of the trailing wall to the leading wall. Providing a lip with an incline may advantageously assist in ameliorating chin lifting when drinking a beverage from the cup. The lip of the cup may be inclined upwardly from the trailing wall to the leading wall at an angle of about 1-7 degrees relative to the base.

The walls of the cup (i.e. the leading, trailing and side walls of the cup) may be angled so as to provide substantially no (or no) residual volume of fluid at the bottom of the cup after drinking from the cup. The cup may be stackable (especially so that one cup will substantially fit within or nest within a second cup). All except the walls defining a headspace of a first cup may fit within a second cup.

The walls of the cup may be of substantially the same thickness. Consequently, the inner and outer walls of each said wall of the cup (i.e. leading, trailing and side walls) may be as described above for each said wall. The cup may be integrally formed. The cup may have a usable volume of from 50 mL to 500 mL, especially from 50 mL to 300 mL, more especially from 100 mL to 250 mL or from 100 to 200 mL, most especially about 150 mL. The cup may have a total volume of from 50 mL to 550 mL, especially from 100 mL to 400 mL, or from 100 mL to 300 mL, more especially from 150 mL to 250 mL, most especially about 200 mL.

The cup may be disposable or non-disposable. The cup may be made from any suitable material, especially plastic. The plastic may be adapted to prevent oxygen ingress. The plastic may include polypropylene. The plastic may include an ethylene vinyl alcohol (EVOH) copolymer. The plastic may be a laminate, especially a laminate of polypropylene and an ethylene vinyl alcohol (EVOH) copolymer.

The cup may include at least one handle, especially one or two handles. Each said handle may be integrally formed with the cup, or may be releasably attached to the cup. Each said handle may be attached to a frame or cradle within which the cup is able to sit.

The cup may also include a lid. The lid may be integrally formed with the cup, or may be releasably attached to the cup. The lid may include a spout from which a patient may drink.

In a second aspect, the present invention provides a cup for a patient suffering from dysphagia. Features of the second aspect may be as described above for the first aspect.

In a third aspect, the present invention provides a cup for a patient suffering from dysphagia, wherein the cup comprises:

a base upon which the cup is capable of standing when on a level surface;

a leading wall extending from the base, wherein the leading wall has a first portion that is substantially planar or concave when viewed from outside the cup, the first portion being at an angle of at least 100 degrees relative to the base; and side walls extending rearwardly from the leading wall, the side walls being convex when viewed from outside of the cup.

In one embodiment, the cup further comprises a trailing wall opposite to the leading wall, wherein the trailing wall includes a portion that is substantially planar or concave when viewed from outside the cup.

Features of the third aspect of the present invention may be as described above for the first and second aspects.

In a fourth aspect, the present invention provides a cup for a patient suffering from dysphagia, wherein the cup comprises:

a base upon which the cup is capable of standing when on a level surface;

a leading wall extending from the base to a lip of the cup, wherein the leading wall has a first portion that is substantially planar or concave when viewed from outside the cup, the first portion being at an angle of at least 100 degrees relative to the base;

a trailing wall opposite the leading wall, wherein the trailing wall extends from the base to the lip of the cup; and side walls extending between the leading and trailing walls, the side walls being convex when viewed from outside of the cup;

wherein the lip of the cup is upwardly inclined relative to the base in the direction of the trailing wall to the leading wall.

Features of the fourth aspect of the present invention may be as described above for the first to third aspects.

In a fifth aspect, the present invention provides a cup assembly, comprising a cup of any one of the first to fourth aspects of the present invention. The cup assembly may include a holder for holding the cup. The holder may include a frame or cradle. The holder may include at least one handle (especially two handles) attached to (or integrally formed with) the frame or cradle. The at least one handle may be of any suitable shape. The at least one handle may include a substantially straight terminal portion or a rounded terminal portion. If the holder includes two handles, they may be positioned on the frame or cradle opposite to each other. The frame or cradle may be configured to support the cup of the first to fourth aspects. The frame or cradle may be configured to slideably engage with the cup, especially the first portion (and optionally the second portion) of the leading and trailing walls. The frame or cradle may be configured to envelop at least a portion of the cup. The cup assembly may also include a lid releasably attached to the cup. The lid may include a spout from which a patient may be able to drink.

In a sixth aspect, the present invention provides a tube of stacked cups of any one of the first to fourth aspects of the present invention.

In a seventh aspect, the present invention provides a pre-packaged food or beverage comprising the cup of any one of the first to fourth aspects of the present invention (or a cup assembly of the fifth aspect), and a food or beverage located within the cup. The pre-packaged food or beverage may include a releasable seal extending across the lip of the cup.

In an eighth aspect, the present invention provides a method for drinking from the cup of any one of the first to fourth aspects of the present invention, the method including a patient placing a thumb on the leading wall of the cup, placing one or more fingers on the trailing wall of the cup, lifting the cup and drinking from the cup. The patient may be suffering from dysphagia.

Features of the fifth to eighth aspects of the present invention may be as described for the first to fourth aspects of the present invention.

Any of the features described herein can be combined in any combination with any one or more of the other features described herein within the scope of the invention.

BRIEF DESCRIPTION OF DRAWINGS

Examples of the invention will now be described by way of example with reference to the accompanying figures, in which.

Figure 1:
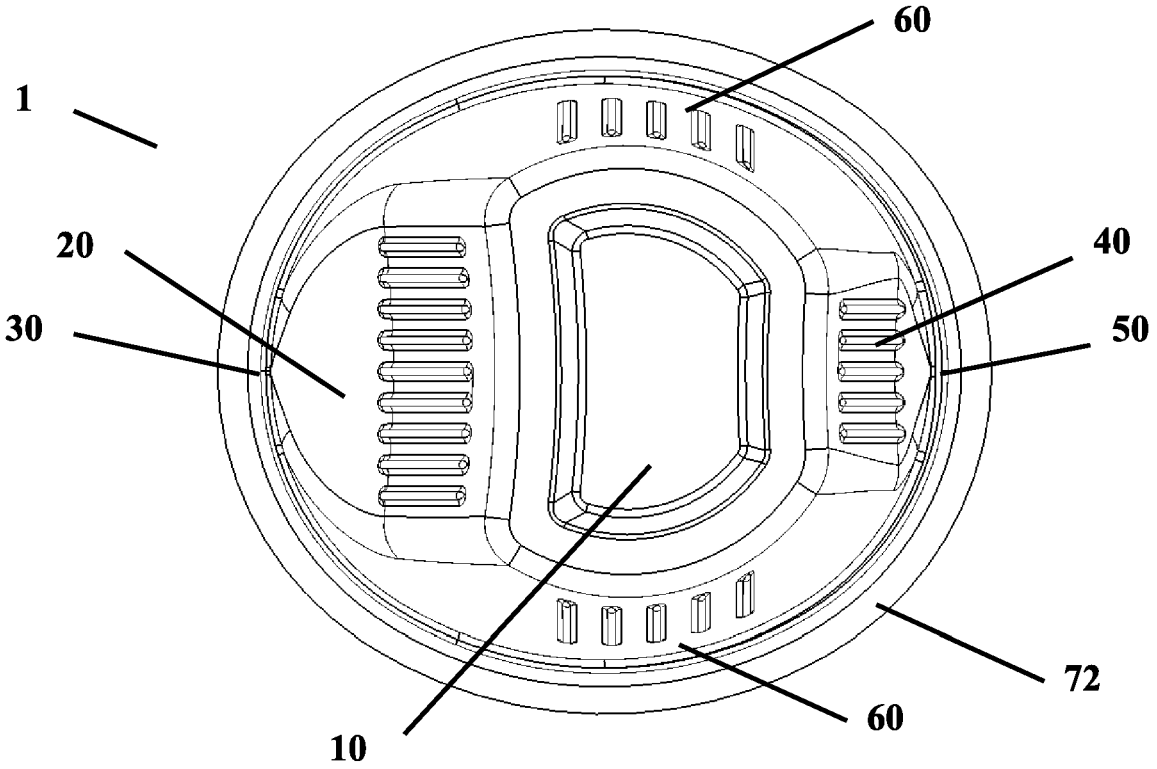
FIG. 1 is a top view of an example cup of the present invention.
Figure 2:
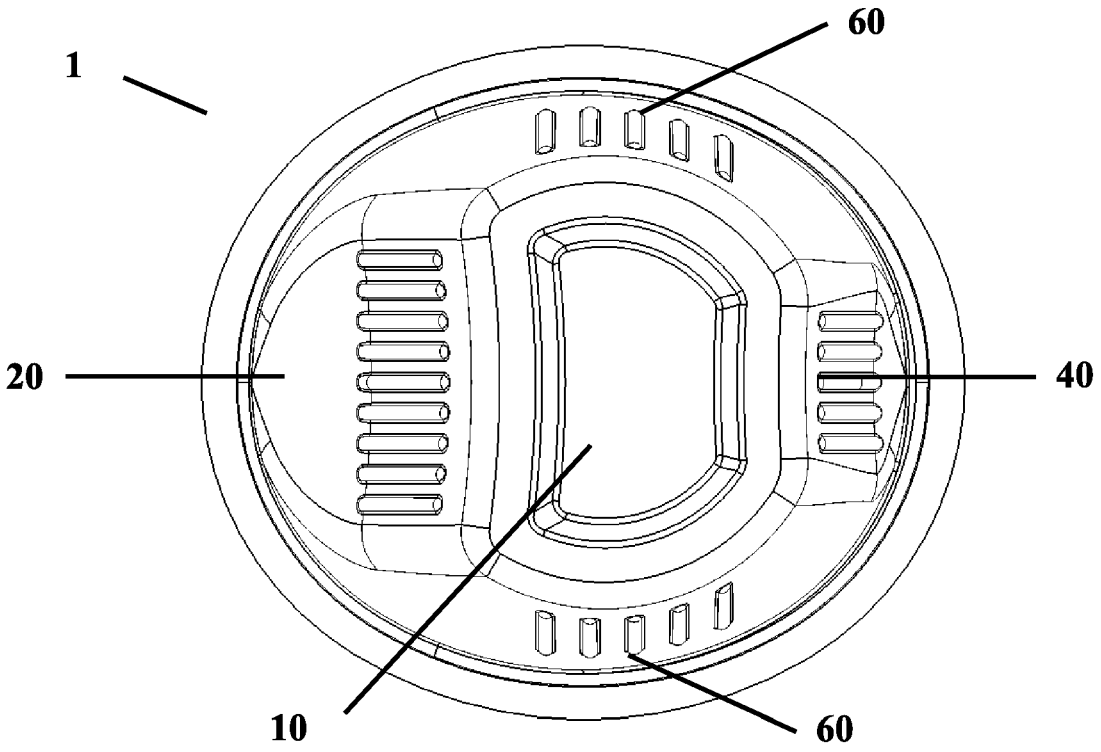
FIG. 2 is a bottom view of the cup of FIG. 1.

Preferred features, embodiments and variations of the invention may be discerned from the following Description which provides sufficient information for those skilled in the art to perform the invention. The following Description is not to be regarded as limiting the scope of the preceding Summary of the Invention in any way.

DESCRIPTION OF EMBODIMENTS

Embodiments of the invention will now be described with reference to FIGS. 1 to 25. In the figures, like reference numerals refer to like features.

FIGS. 1 to 8 illustrate a cup 1 for a patient suffering from dysphagia. The cup 1 includes a base 10 upon which the cup is capable of standing when on a level surface. The cup 1 also includes a leading wall 20 extending from the base 10. At least 50% of the length of the leading wall 20 is at an angle of at least 100 degrees relative to the base 10. Preferably, the lower 50% of the length of the leading wall 20 is at an angle of at least 100 degrees relative to the base 10. Furthermore, in a plane parallel to the base 10 a lip 30 of the leading wall 20 is arcuate with a greater curvature than a lower first portion 22 of the leading wall 20. The leading wall 20 is the wall of the cup 1 that faces a patient, if the patient were drinking from the cup 1.

Figure 3:
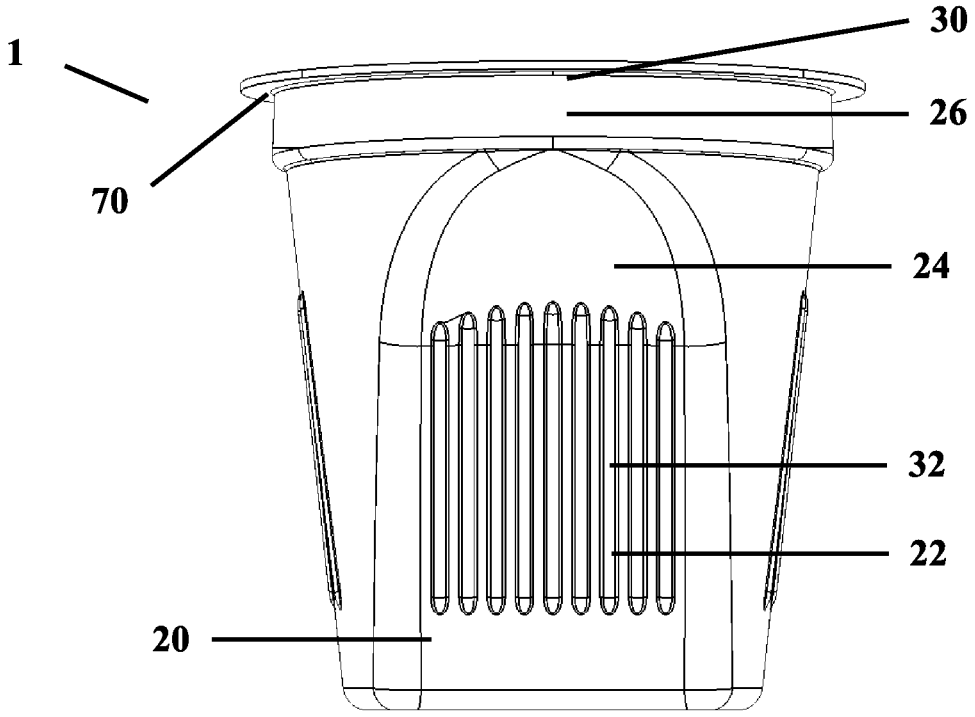
FIG. 3 is a front view of the cup of FIG. 1.
Figure 4:
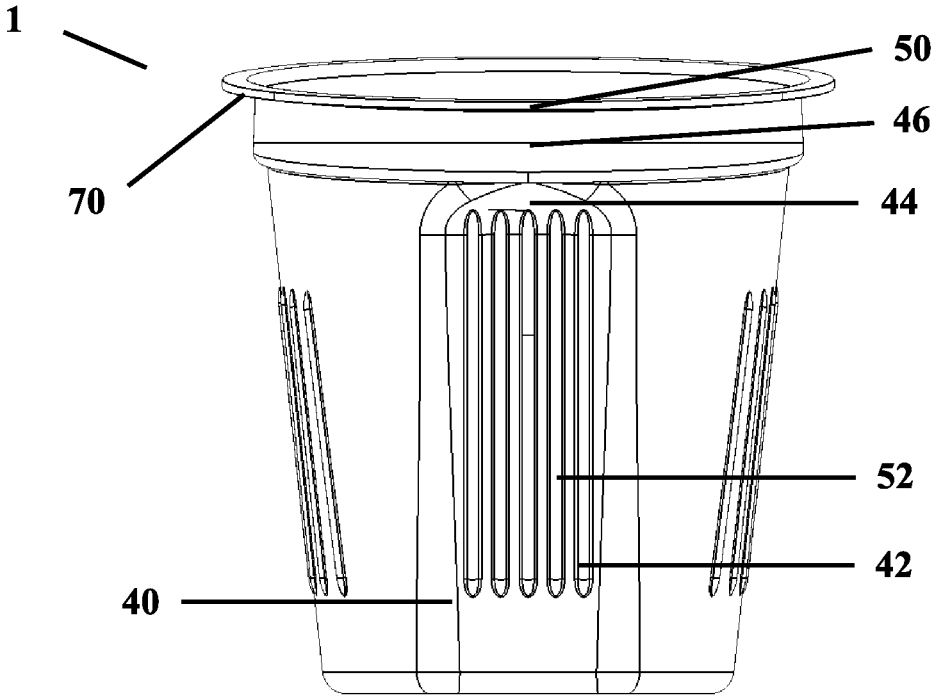
FIG. 4 is a back view of the cup of FIG. 1.
Figure 5:
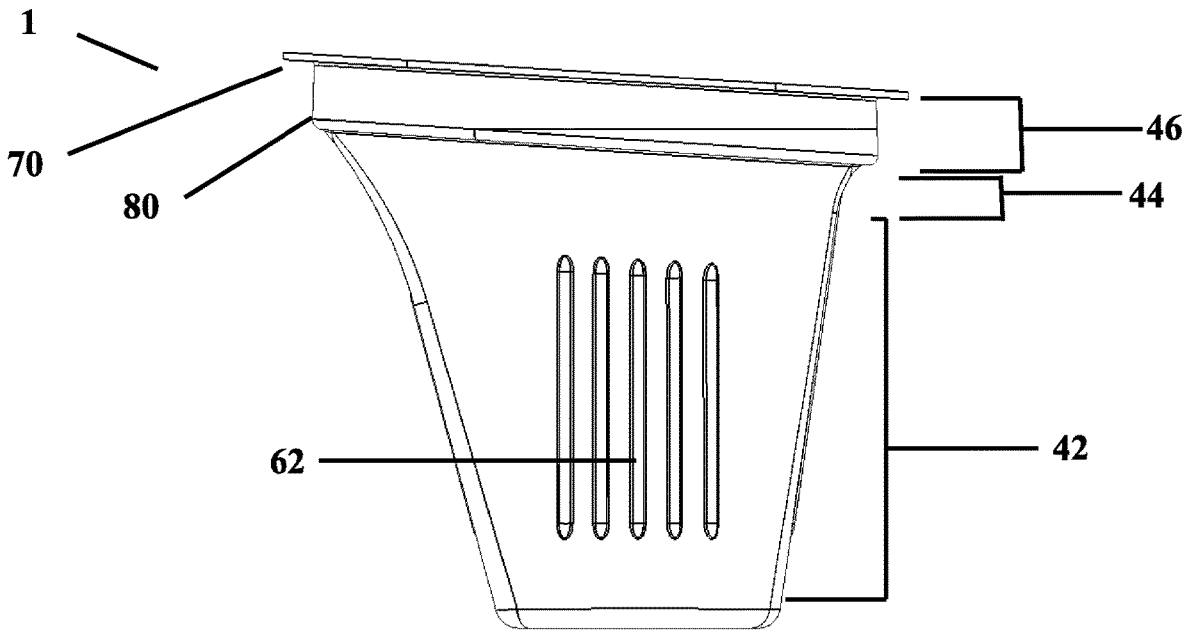
FIG. 5 is a side view of the cup of FIG. 1.
Figure 6:
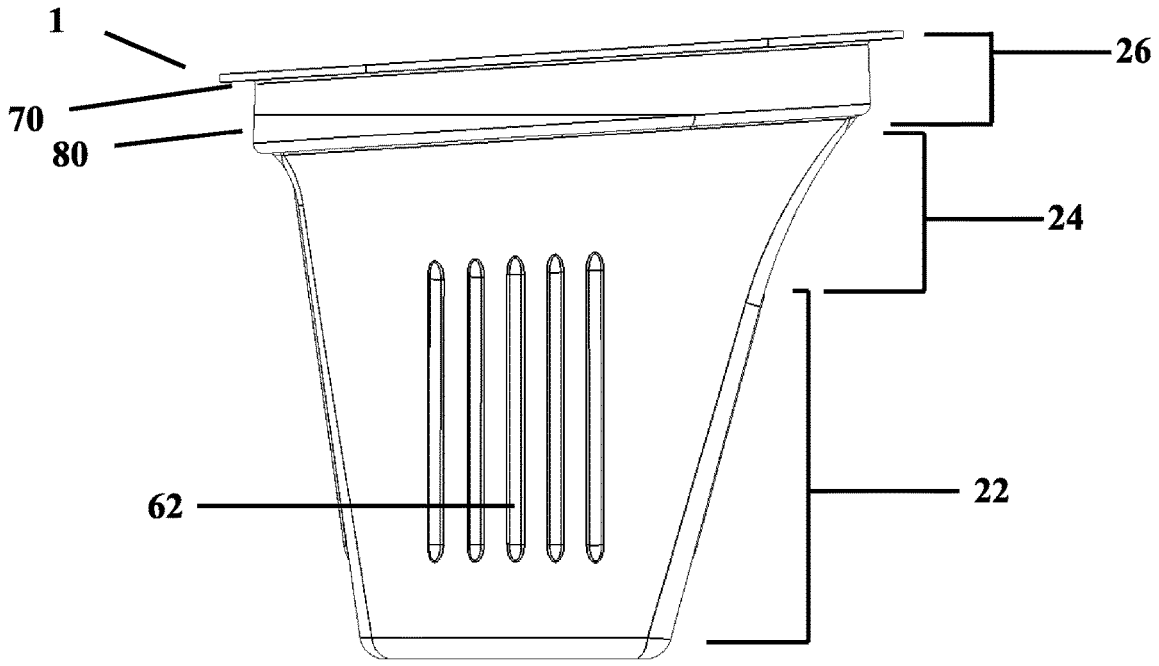
FIG. 6 is a side view of the cup of FIG. 1.
Figure 7:
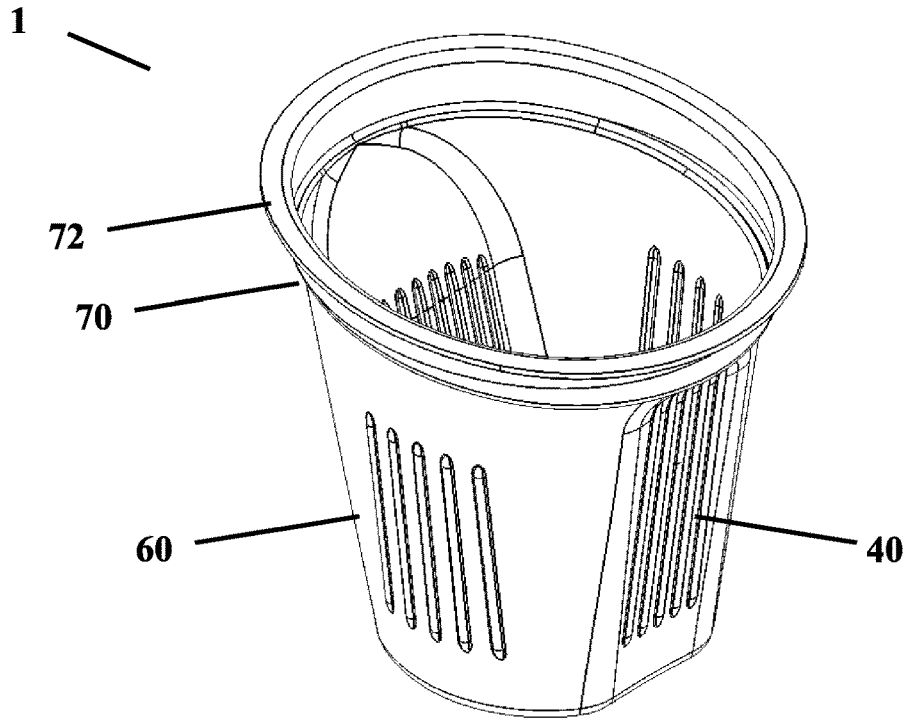
FIG. 7 is an isometric view of the cup of FIG. 1.
Figure 8:
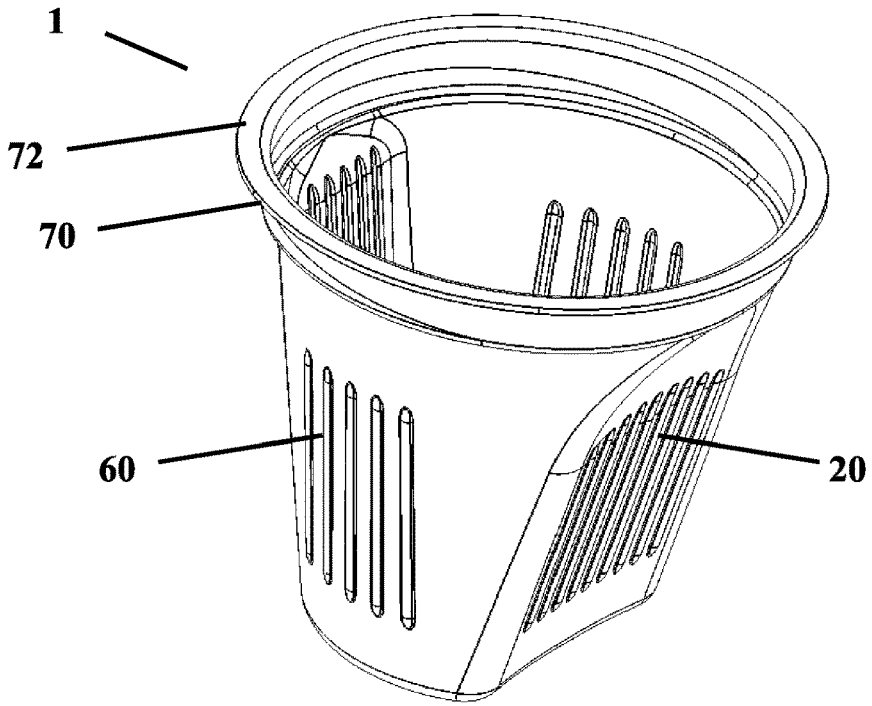
FIG. 8 is a perspective view of the cup of FIG. 1.
Figure 9:
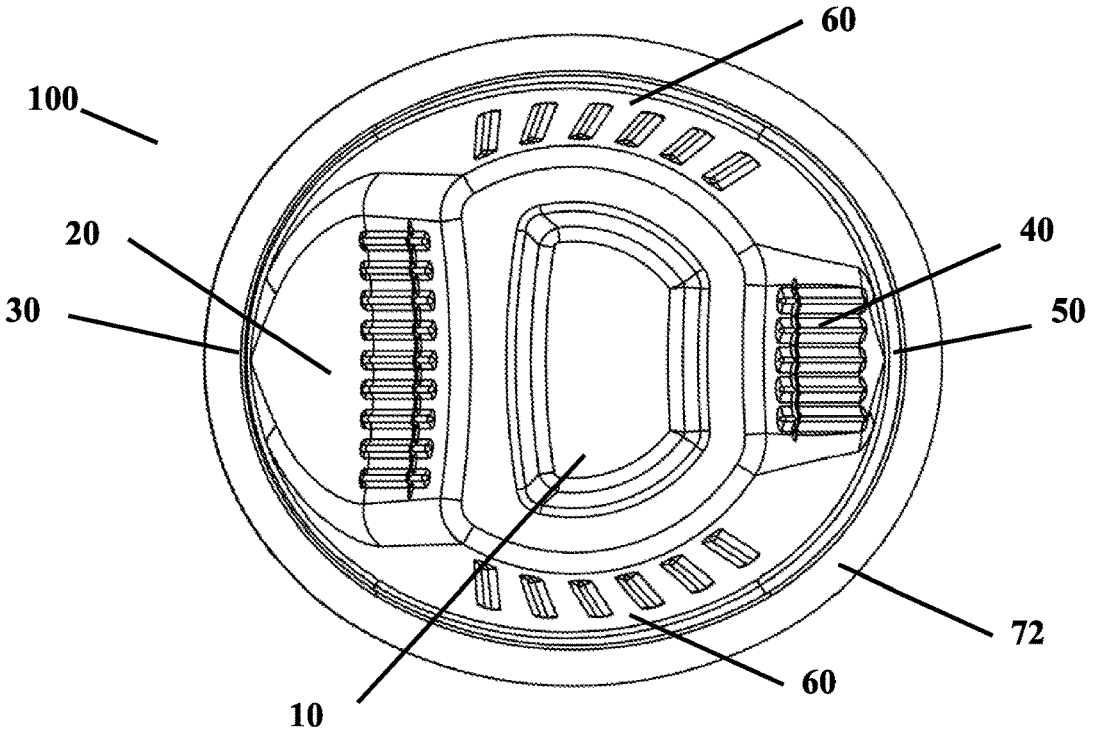
FIG. 9 is a top view of a second example cup of the present invention.
Figure 10:
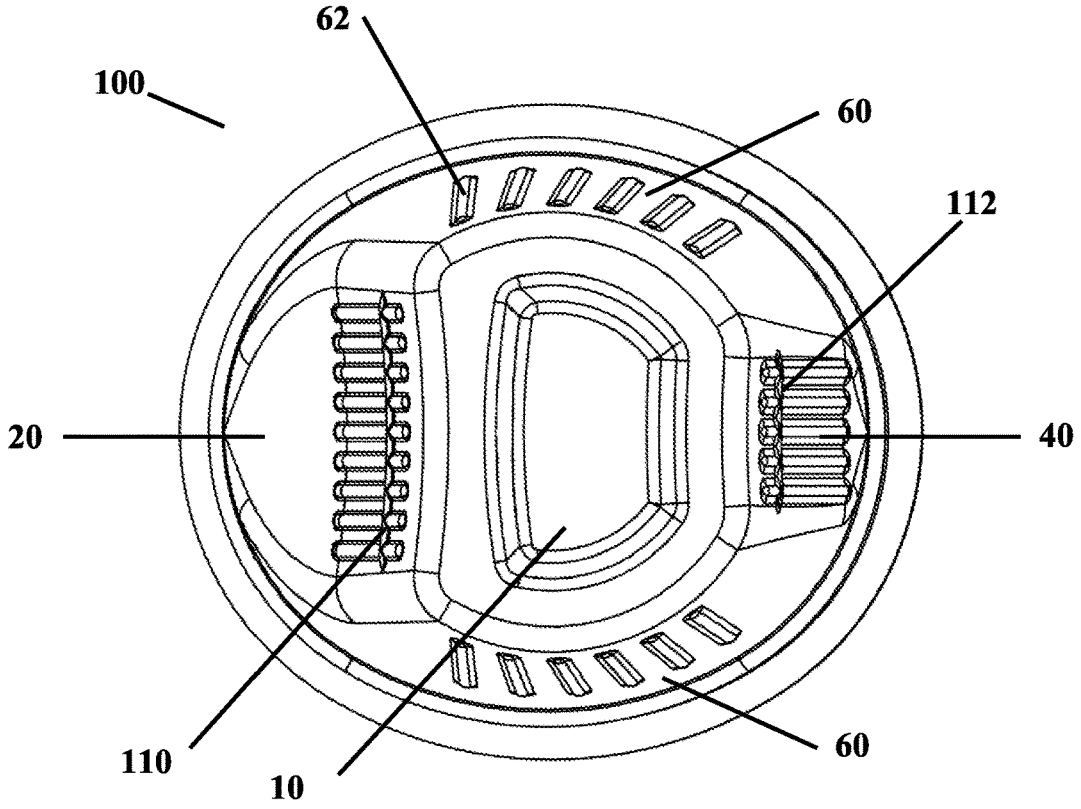
FIG. 10 is a bottom view of the cup of FIG. 9.
Figure 11:
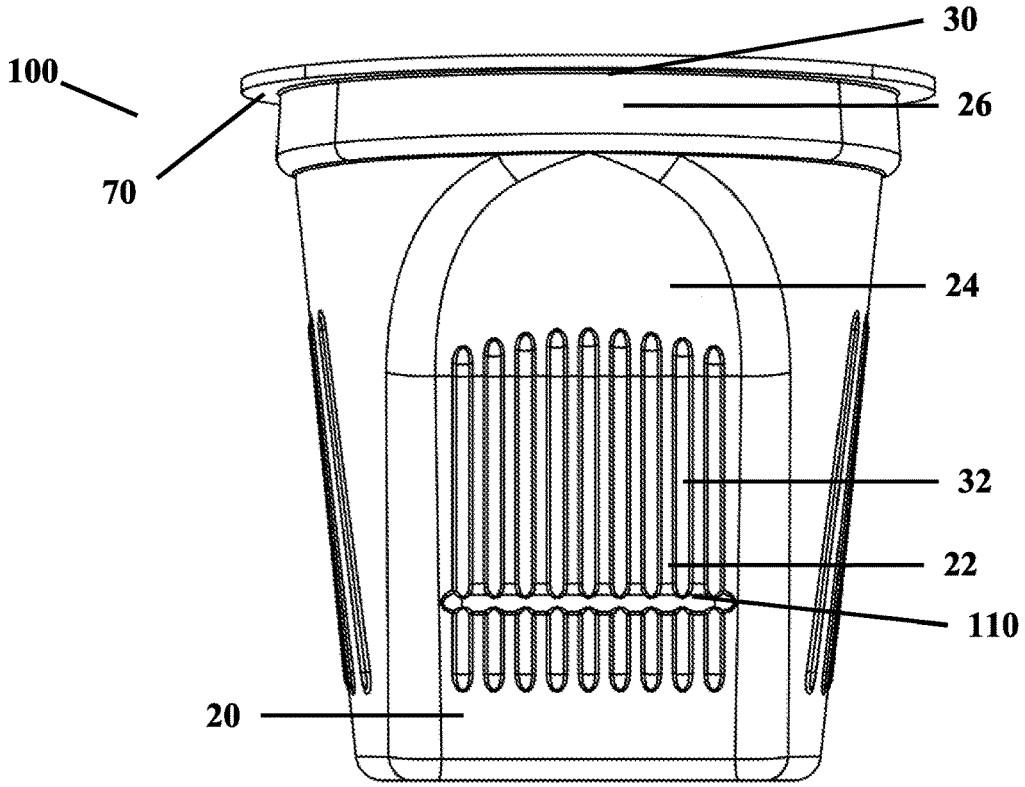
FIG. 11 is a front view of the cup of FIG. 9.
Figure 12:
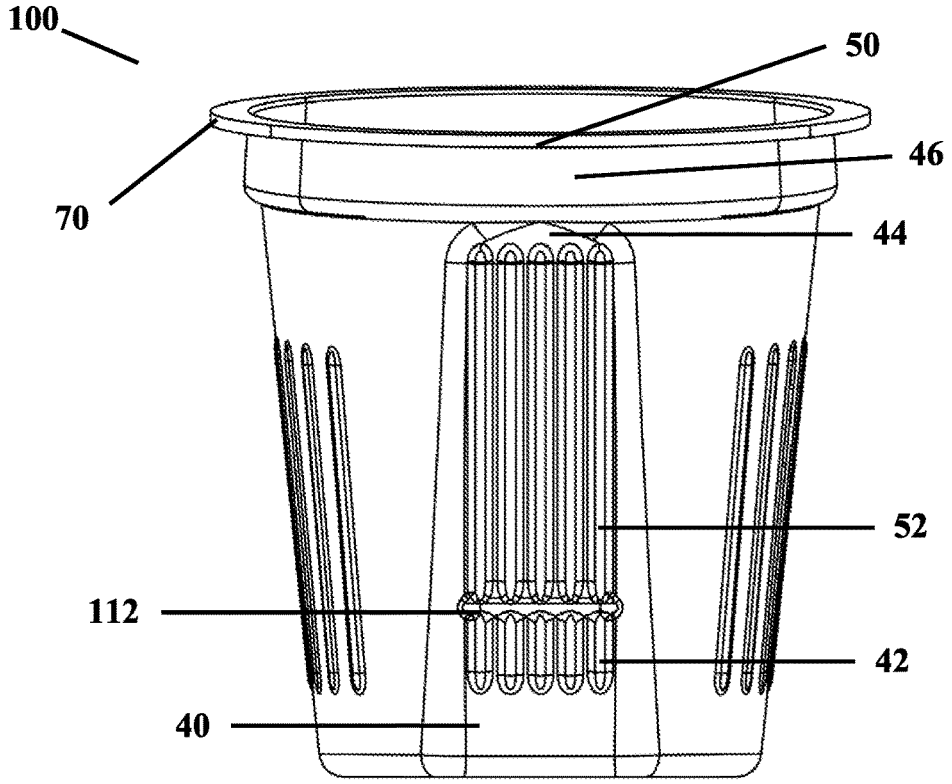
FIG. 12 is a back view of the cup of FIG. 9.
Figure 13:
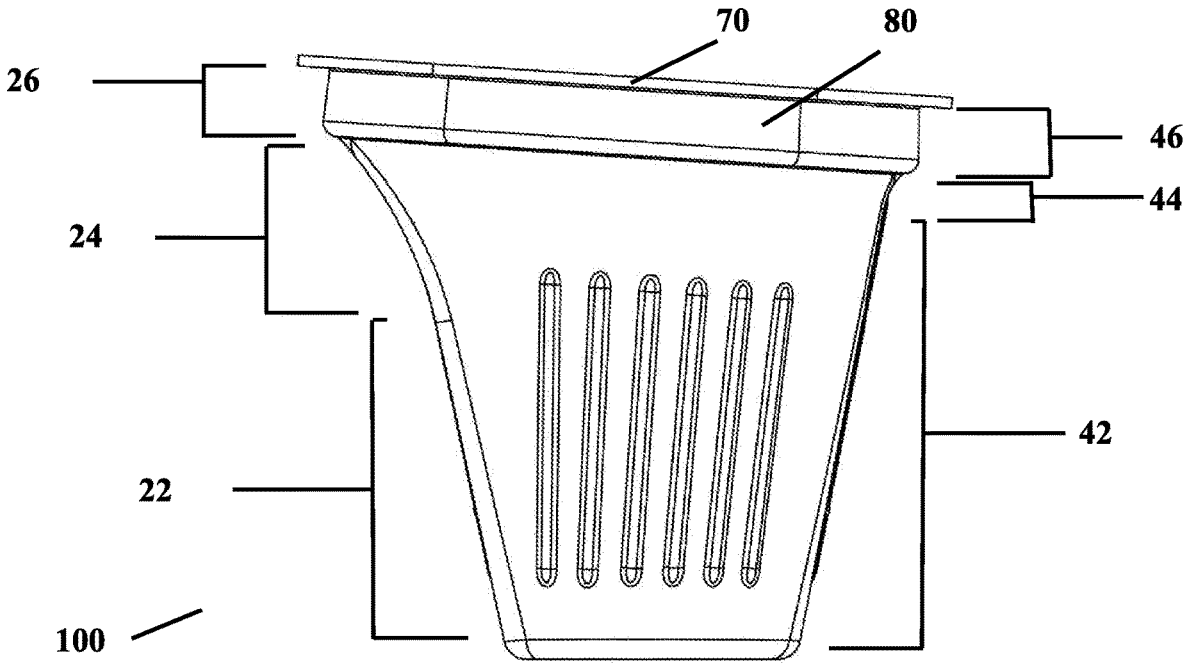
FIG. 13 is a side view of the cup of FIG. 9.

As shown in FIGS. 3 and 6, the leading wall 20 includes a first portion 22 proximate to the base 10 (in the cup 1 of FIGS. 1 to 8, the first portion 22 is the same as the lower first portion 22), a second portion 24 distal to the base 10 and adjacent the first portion 22, and a third portion 26 distal the base 10 of the cup and adjacent to the second portion 24. In the cup 1 of FIGS. 1 to 8, the first portion 22 extends for about 60% of the length of the leading wall 20, and the first portion 22 extends at an angle of about 105 degrees relative to the base 10 of the cup. The second portion 24 curves longitudinally outwardly from the center of the cup 1 and extends for about 25% of the length of the leading wall 20. The third portion 26 extends for about 15% of the length of the leading wall 20. At least a section of the third portion 26 may be substantially perpendicular relative to the base 10. In the cup of FIG. 1-8, the leading wall is about 9 cm long, with the first portion about 5.5 cm long, the second portion about 2.2 cm long and the third portion about 1.3 cm long.

The lip 30 of the leading wall (which may form part of the third portion 26) is arcuate, and the first portion 22 is concave (when viewed from outside the cup) to provide a depression to accommodate a patient's thumb. The first portion 22 is about 3.7 cm wide and is of substantially constant width along its length. The second portion 24 narrows in width towards the lip 30 and is generally arch-shaped.

The first portion 22 of the leading wall includes nine longitudinally extending ridges 32, and each ridge is about 4 mm apart and about 2 mm thick. The longitudinally extending ridges 32 may assist a patient to grip the cup 1 and may also assist in destacking the cups 1 (when two or more cups 1 are nested together).

The cup 1 includes a trailing wall 40 extending from the base 10 opposite to the leading wall 20. As illustrated in FIGS. 4 and 5, the trailing wall 40 includes a first portion 42 proximate to the base 10, a second portion 44 distal to the base 10 and adjacent the first portion 42, and a third portion 46 distal the base 10 of the cup and adjacent to the second portion 44. In the cup 1 of FIGS. 1 to 8, the first portion 42 extends for about 75% of the length of the trailing wall 40, and the first portion 42 extends at an angle of about 98-99 degrees relative to the base 10 of the cup. The second portion 44 curves longitudinally outwardly from the center of the cup 1 and extends for about 6% of the length of the trailing wall 40. The third portion 46 extends for about 17% of the length of the trailing wall 40. At least a section of the third portion 46 is substantially perpendicular relative to the base 10. In the cup of FIGS. 1-8, the leading wall is about 8 cm long, with the first portion about 6.1 cm long, the second portion about 0.6 cm long and the third portion about 1.3 cm long.

The lip 50 of the trailing wall (which may form part of the third portion 46) is arcuate, and the first portion 42 is concave (when viewed from outside the cup) to accommodate a patient's fingers when drinking from the cup 1. The first portion 42 is about 2.3 cm wide and is of substantially constant width along its length. The second portion 24 narrows in width towards the lip 30 and is generally arch-shaped. The distance between the top of the first portion of the leading and trailing walls 22, 42 is about 57 mm. This distance may advantageously assist a patient to grip the cup 1.

The first portion 42 of the trailing wall includes five longitudinally extending ridges 52, and each ridge is about 4 mm apart and about 2 mm thick. The longitudinally extending ridges 52 may assist a patient to grip the cup 1 and may also assist in destacking the cups 1 (when two or more cups 1 are nested together).

The cup 1 includes a plane of symmetry bisecting the leading and trailing walls 20, 40. The cup 1 includes two side walls 60, which each extend between the leading and trailing walls 20, 40. At least 80% of the length of each side wall 60 is at an angle of about 96 degrees relative to the base 10. Each side wall 60 includes five longitudinally extending ridges 62. Each ridge 62 is about 2 mm thick and about 5 mm apart.

The lip 70 of the cup is ovoid to accommodate a patient's nose when drinking from the cup 1. The distance at the lip 70 between the inside of the leading and trailing walls 20, 40 (i.e. along a plane bisecting the leading and trailing walls 20, 40) is about 7.7 cm, and the distance between the outside of the leading and trailing walls 20, 40 is about 8.6 cm. The distance between the inside of the two side walls 60 (i.e. along a plane bisecting the two side walls 60) is about 6.7 cm, and the distance between the outside of the two side walls 60 is about 7.8 cm. The inner circumference of the lip 70 is about 230 mm. The outer circumference of the lip 70 is about 260 mm. The lip 70 is angled at about a 4 degree upward incline relative to the base from the trailing wall 40 to the leading wall 20. This also reduces the need for a patient to tilt his or her head backwards during drinking (i.e. lifting the chin), thereby assisting in keeping the laryngeal inlet closed during drinking.

The lip 70 includes a flange 72 (the lip 70 is formed from the leading and trailing walls 20, 40 and the side walls 60). The flange 72 is about 5 mm wide and is adapted for adhesion of a seal to seal the contents of the cup 1. The cup includes a substantially cylindrical headspace 80 defined by the walls 20, 40, 60 of the cup 1 (including the third portions 26, 46 of the leading and trailing walls 20, 40). The usable volume of the cup (below the headspace 80) is about 150 mL. The total volume (including the headspace 80) is about 200 mL.

The walls of the cup 1 are angled so as to provide substantially no residual volume of fluid at the bottom of the cup 1 after drinking from the cup 1. The cup is stackable, so that one cup 1 will substantially fit within or nest within a second cup 1. The walls of the cup 1 are of substantially the same thickness. The cup may be made from a laminate of polypropylene and an ethylene vinyl alcohol (EVOH) copolymer.

Figure 14:
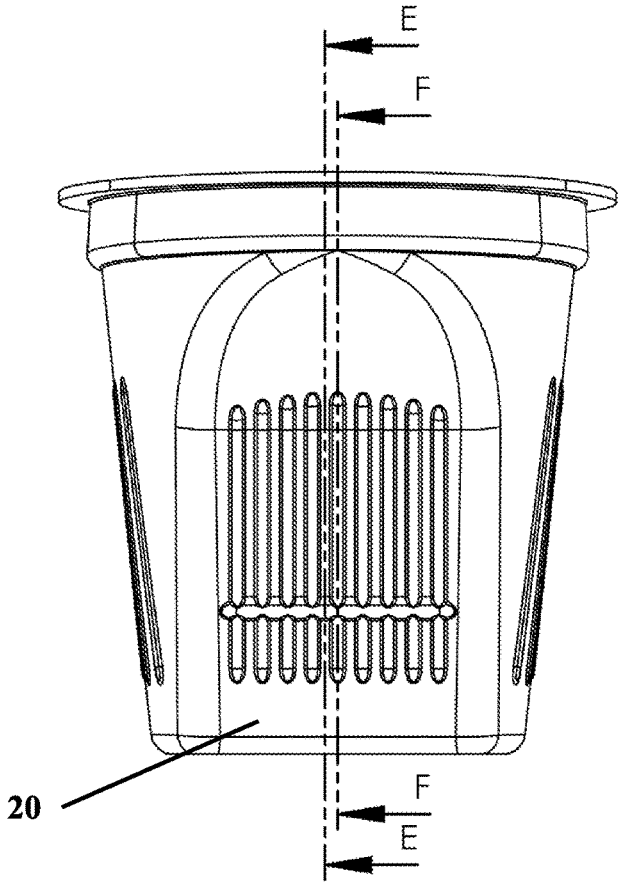
FIG. 14 is a second front view of the cup of FIG. 9.
Figure 15:
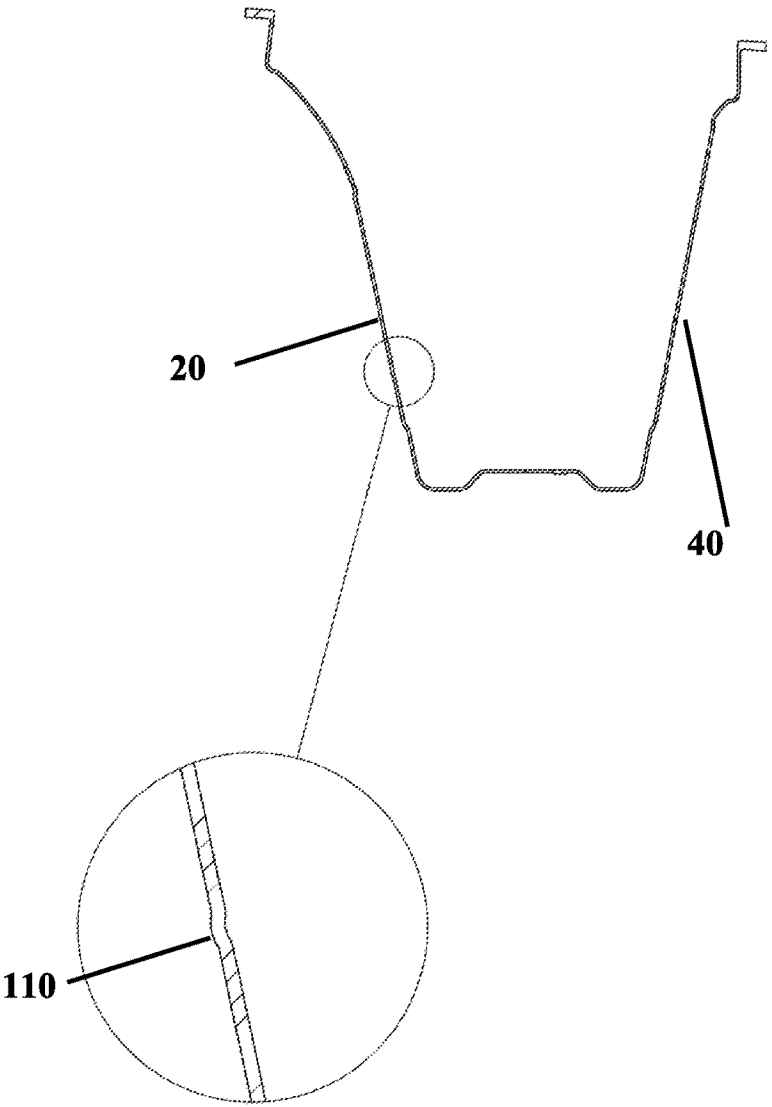
FIG. 15 is a cross-sectional view through line F-F of the cup of FIG. 14.
Figure 16:
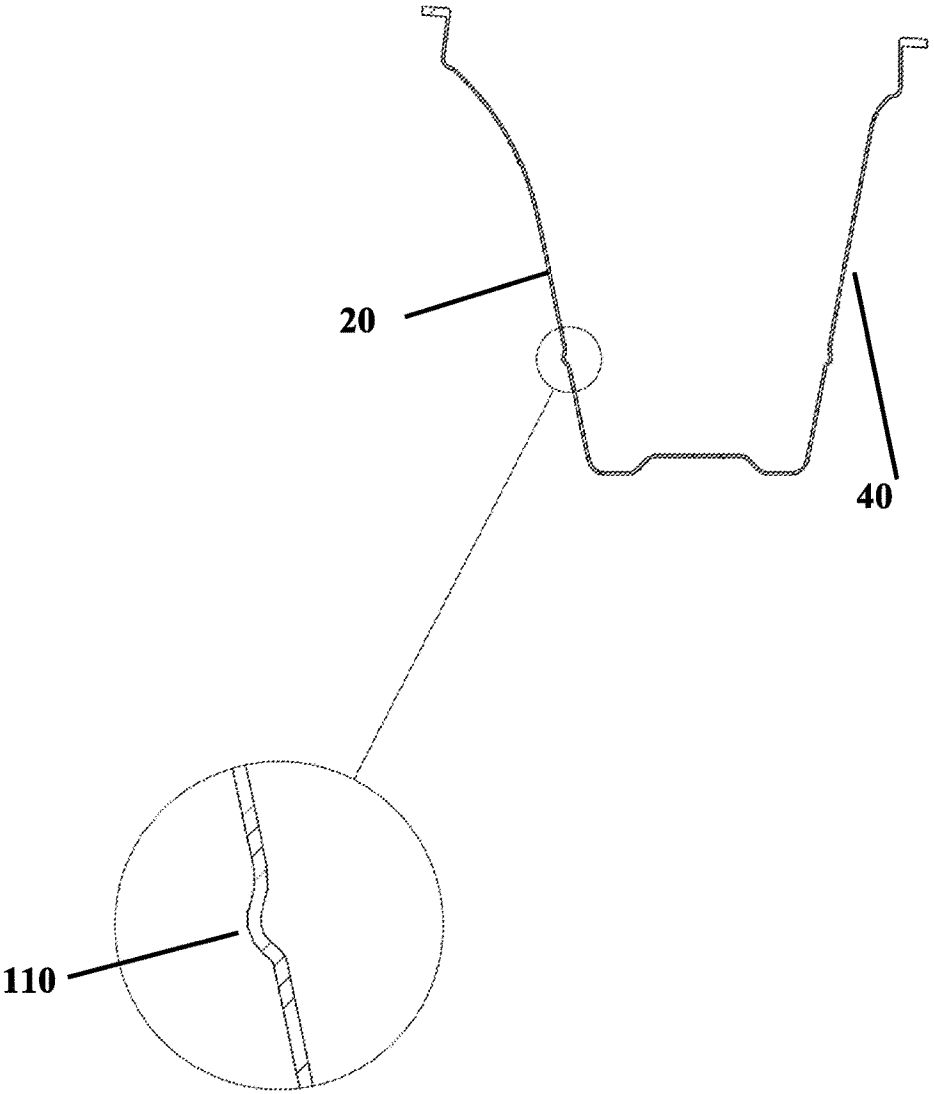
FIG. 16 is a cross-sectional view through line E-E of the cup of FIG. 14.
Figure 17:
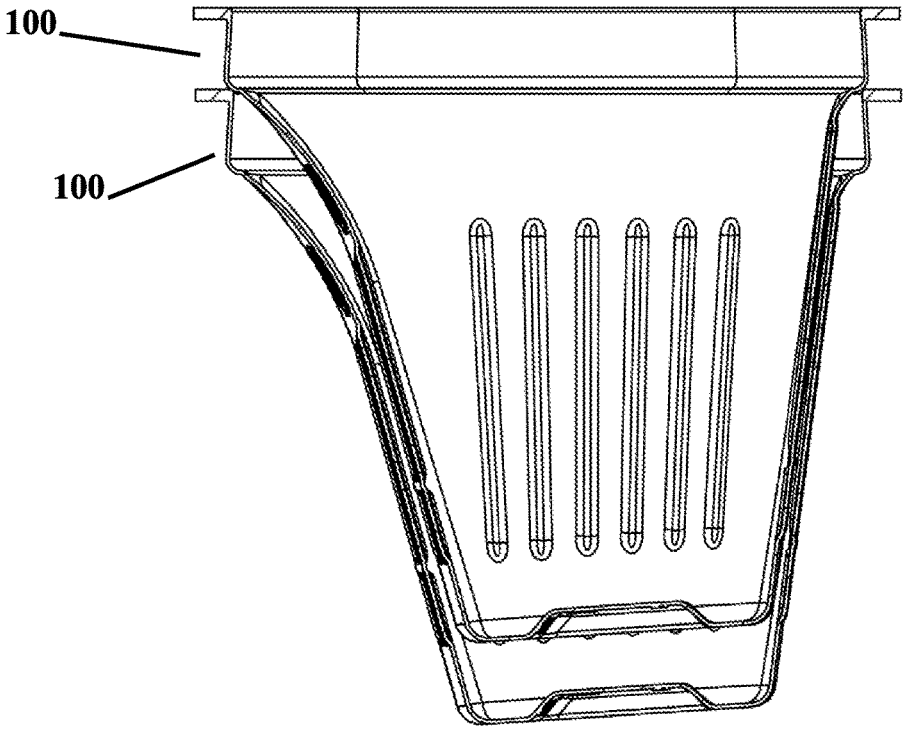
FIG. 17 is a side view of a first cup of FIG. 9 stacked inside a second cup of FIG. 9.
Figure 18:
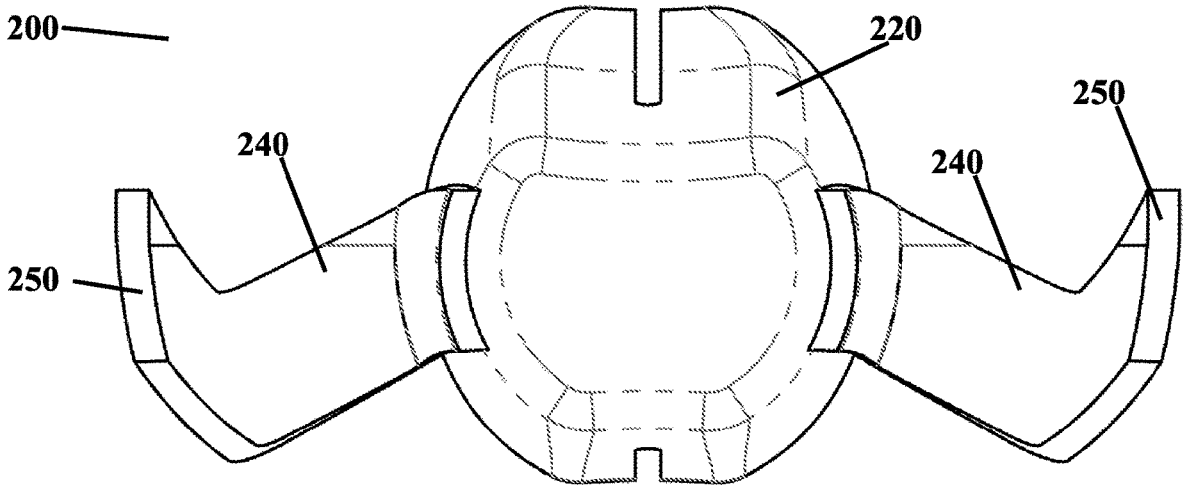
FIG. 18 is a bottom view of a holder for the cup of FIG. 9.
Figure 19:
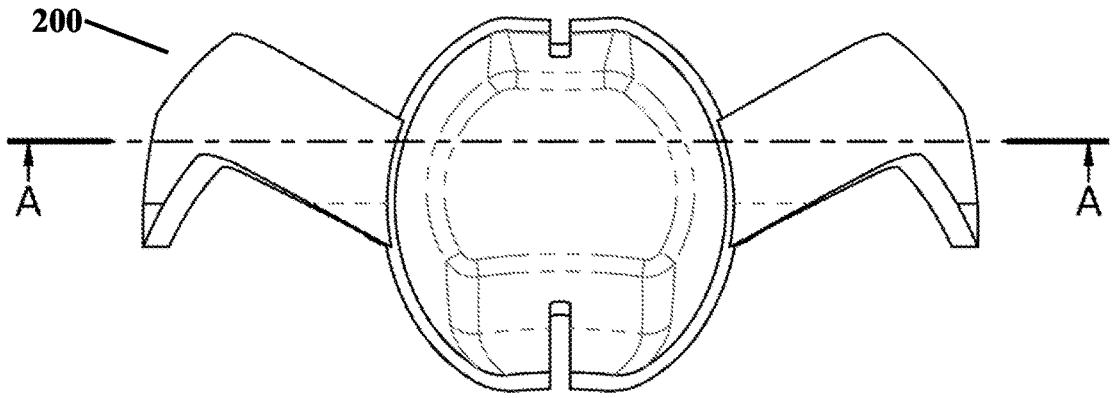
FIG. 19 is a top view of the holder of FIG. 18.
Figure 20:
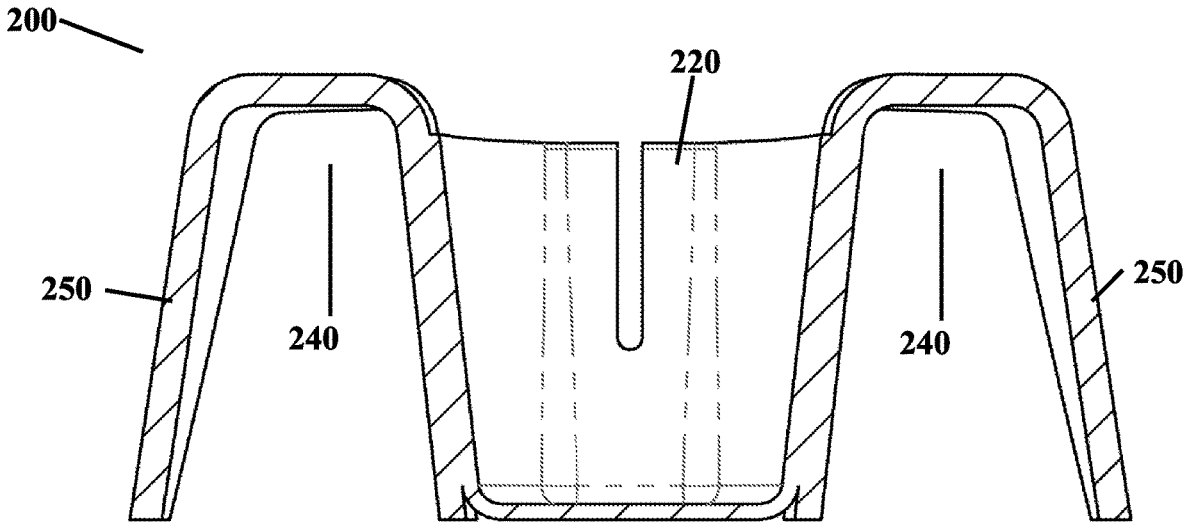
FIG. 20 is a cross sectional view through line A-A of the holder of FIG. 19.
Figure 21:
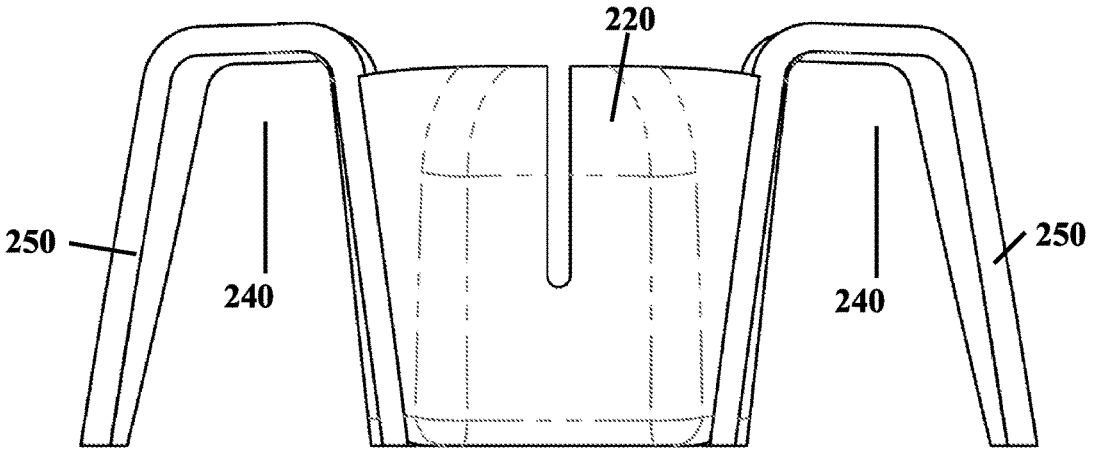
FIG. 21 is a front view of the holder of FIG. 18.
Figure 22:
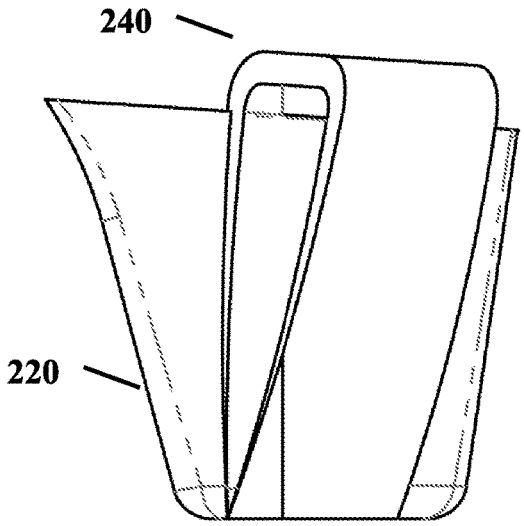
FIG. 22 is a side view of the holder of FIG. 18.
Figure 23:
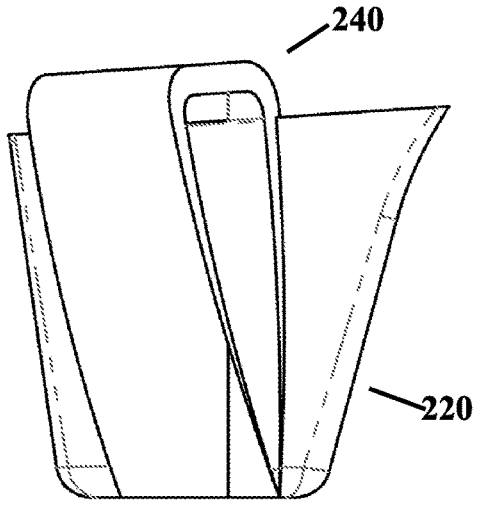
FIG. 23 is a side view of the holder of FIG. 18.
Figure 24:
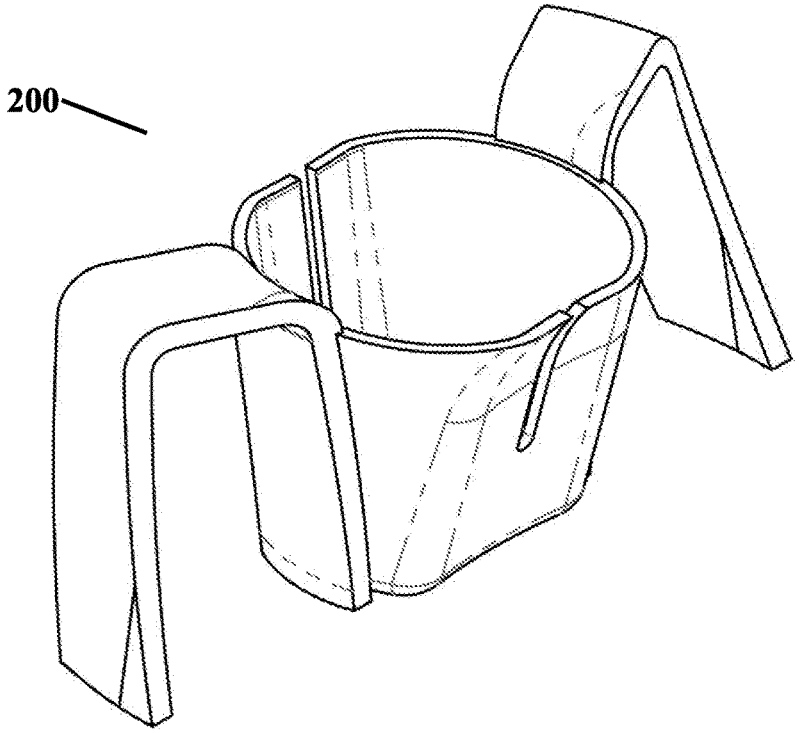
FIG. 24 is a perspective view of the holder of FIG. 18.
Figure 25:
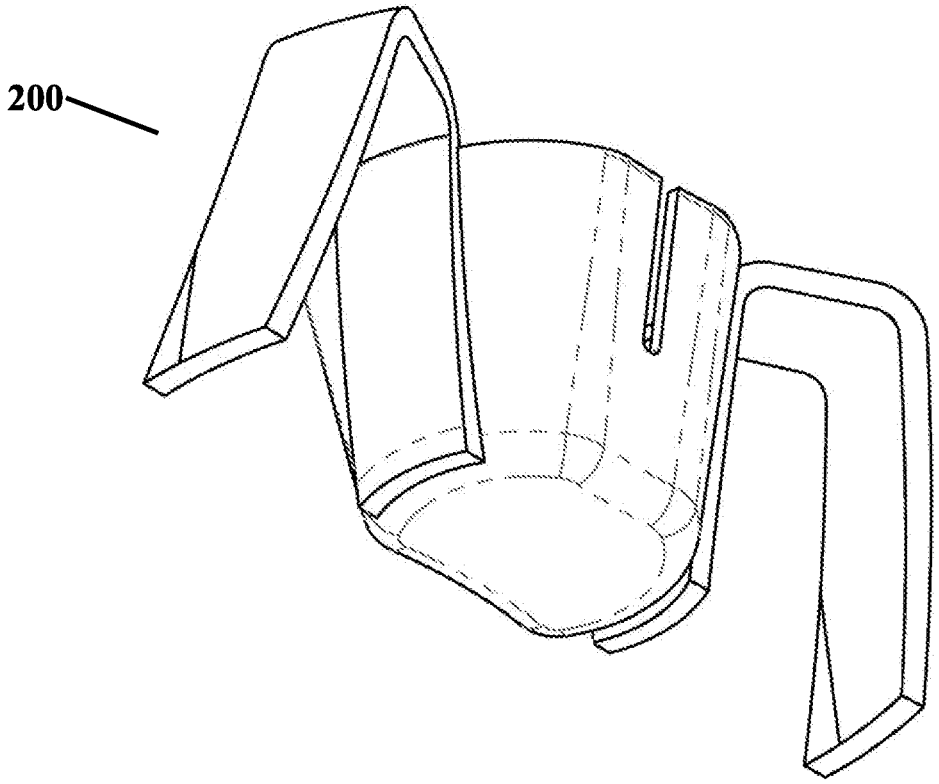
FIG. 25 is a perspective view of the holder of FIG. 18.

FIGS. 9 to 17 illustrate a second example cup 100 for a patient suffering from dysphagia. The cup 100 may be as described above for the cup of FIGS. 1 to 8. However, the cup of FIGS. 9 to 17 includes six longitudinally extending ridges 62. Each ridge 62 is positioned at an angle relative to the base 10. The cup 100 also includes a horizontally extending ridge 110 in the first portion 22 of the leading wall 20, and a horizontally extending ridge 112 in the first portion 42 of the trailing wall 40. As shown in FIGS. 14 to 16, the horizontally extending ridge 110 protrudes slightly further than longitudinally extending ridges 32. Horizontally extending ridges 110, 112 act to stabilize the cup 100 in the holder 200 (as shown in FIGS. 18 to 25, as described below). Horizontally extending ridges 110, 112 also assist in improving the lateral rigidity of the first portion 22 of the leading wall 20, and the first portion 42 of the trailing wall 40. FIG. 17 shows two cups 100 stacked together.

In preferred embodiments of the present invention, the cup includes an angled lower portion of the leading wall and an oval-shaped opening at the top of the cup. The angle of the lower portion of the leading wall, in combination with the oval-shaped opening at the top of the cup, means that the cup can be emptied without the person drinking from the cup having to tilt their head backwards to any great extent. The angle of the lower portion of the leading wall facilitates emptying of the cup without requiring that the cup be tilted to as much of an angle as that required for cups without such an angle in the leading wall. Further, the oval-shaped opening at the top of the cup provides clearance around the nose of the user when the cup is tilted, thereby further obviating the need for the user to tilt their head backwards during drinking. This beneficial effect is even further enhanced in embodiments where the top of the cup angles downwardly from the leading edge to the trailing edge of the top of the cup. In these embodiments, the trailing edge of the top of the cup is lower than the leading edge of the top of the cup and therefore the cup may be tilted to a greater angle before the trailing edge of the top of the cup comes into close proximity with the nose or face of the user. Cups of preferred embodiments of the present invention may contain volumes of fluid that are larger than other cups that are of small size to avoid coming into contact with the nose of the user during drinking. This also enhances convenience for the user in that it is not necessary to fill the cup multiple times to enable a reasonable volume of fluid to be drunk.

FIGS. 18 to 25 illustrate a holder 200 for holding the cup 100 of FIGS. 9 to 17. The holder 200 includes a cradle 220 configured to support the cup 100. The cradle 220 is configured to slideably engage with the cup 100, especially at least the first portion 22, 42 of the leading and trailing walls 20, 40. The cradle 220 is configured to envelop a portion of the cup 100. The holder 200 also includes two handles 240 attached to the cradle 220. The handles 240 may include substantially straight terminal portions 250 (as shown in FIGS. 18 to 25) or rounded terminal portions.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

The invention claimed is:

1. A cup for a patient suffering from dysphagia, wherein the cup comprises:

a base upon which the cup is capable of standing when on a level surface;

a leading wall extending from the base to a lip of the cup, wherein the leading wall includes a first portion proximate to the base of the cup that is substantially planar or concave when viewed from outside the cup, the first portion being at an angle of at least 100 degrees relative to the base, and wherein the leading wall includes a second portion distal to the base of the cup and adjacent the first portion, wherein the second portion curves longitudinally outwardly from the center of the cup;

a trailing wall opposite the leading wall, wherein the trailing wall extends from the base to the lip of the cup; and side walls extending between the leading and trailing walls, the side walls being convex when viewed from outside of the cup;

wherein the lip of the cup is upwardly inclined relative to the base in the direction of the trailing wall to the leading wall and wherein the lip of the cup is ovoid or elliptical for accommodating a patient's nose drinking from the cup.

2. The cup according to claim 1, wherein the first portion of the leading wall extends for at least 30% of the length of the leading wall.

3. The cup according to claim 1, wherein the first portion of the leading wall extends for from 50% to 70% of the length of the leading wall.

4. The cup of claim 1, wherein the first portion of the leading wall is at an angle of from 102 to 108 degrees relative to the base of the cup.

5. The cup according to claim 1, wherein the second portion extends for from 15% to 35% of the length of the leading wall.

6. The cup according to claim 1, wherein the first portion of the leading wall is concave when viewed from outside the cup.

7. The cup according to claim 1, wherein at least 50% of the length of the trailing wall is at an angle of less than 105 degrees relative to the base.

8. The cup according to claim 7, wherein the trailing wall includes a first portion proximate to the base of the cup, wherein the first portion extends for at least 60% of the length of the trailing wall, and wherein the first portion is at an angle of from 95 to 101 degrees relative to the base of the cup.

9. The cup according to claim 8, wherein the first portion of the trailing wall is substantially planar or concave when viewed from outside the cup.

10. The cup according to claim 8, wherein the distance between the top of the first portion of the leading and trailing walls is less than 71 mm.

11. The cup according to claim 1, wherein the cup is shaped so that a first said cup substantially fits within a second said cup.

12. The cup according to claim 1, wherein the leading and trailing walls each include a plurality of longitudinally extending ridges.

13. The cup according to claim 1, wherein the upwardly inclined lip is inclined upwardly from the trailing wall to the leading wall at an angle of about 1-7 degrees relative to the base.

14. The cup according to claim 13, wherein the upwardly inclined lip is inclined upwardly from the trailing wall to the leading wall at an angle of about 4 degrees relative to the base.

15. The cup according to claim 1, wherein the walls of the cup are of substantially the same thickness.

16. The cup according to claim 1, having a total volume of from 100 to 300 mL.

17. A cup assembly, comprising a cup of claim 1 and at least one of:

a holder for holding the cup including a cradle configured to support the cup and at least one handle attached to the cradle; and a lid releasably attached to the cup.

18. A prepackaged food or beverage comprising the cup of claim 1;

a food or beverage located within the cup; and a releasable seal extending across the lip of the cup.

* * * * *